US008640787B2

(12) United States Patent
Rohrer

(10) Patent No.: US 8,640,787 B2
(45) Date of Patent: Feb. 4, 2014

(54) PORTABLE POST DRIVING APPARATUS

(76) Inventor: Daniel F. Rohrer, Powell Butte, OR (US)

( * ) Notice: Subject to any disclaimer, the term of this patent is extended or adjusted under 35 U.S.C. 154(b) by 396 days.

(21) Appl. No.: 12/655,528

(22) Filed: Dec. 30, 2009

(65) Prior Publication Data

US 2011/0155403 A1 Jun. 30, 2011

(51) Int. Cl.

| | |
|---|---|
| ***B23Q 5/00*** | (2006.01) |
| ***B23B 45/16*** | (2006.01) |
| ***B25D 9/00*** | (2006.01) |
| ***B25D 11/00*** | (2006.01) |
| ***B25D 13/00*** | (2006.01) |
| ***B25D 16/00*** | (2006.01) |
| ***E21B 1/00*** | (2006.01) |

(52) U.S. Cl.

USPC ..... 173/114; 173/14

(58) Field of Classification Search

USPC ..... 173/90–118, 1–2, 11, 13–17, 131, 135, 173/198, 200–201, 206–207; 137/625.19; 224/492, 42; 227/51, 66, 130

See application file for complete search history.

(56) References Cited

U.S. PATENT DOCUMENTS

| | | | | | |
|---|---|---|---|---|---|
| 1,391,676 | A | * | 9/1921 | Finley | 137/112 |
| 2,557,884 | A | * | 6/1951 | Mueller et al. | 425/136 |
| 2,610,022 | A | * | 9/1952 | Meddock | 137/625.69 |
| 2,837,107 | A | * | 6/1958 | Rockwell | 137/106 |
| 3,006,595 | A | * | 10/1961 | Rosebrook | 251/3 |
| 3,026,905 | A | * | 3/1962 | Kjell | 137/637 |
| 3,160,486 | A | * | 12/1964 | Busch, Jr. | 137/624.14 |
| 3,240,124 | A | * | 3/1966 | Howard et al. | 91/1 |
| 3,408,897 | A | * | 11/1968 | Hoen et al. | 91/5 |
| 3,465,834 | A | * | 9/1969 | Hamilton, Jr. | 173/2 |
| 3,523,555 | A | * | 8/1970 | Padula | 137/625.64 |
| 3,736,958 | A | * | 6/1973 | Rostad | 137/625.6 |
| 3,983,791 | A | * | 10/1976 | Holopainen | 91/466 |
| 4,071,046 | A | * | 1/1978 | Cates | 137/596.15 |
| 4,215,723 | A | * | 8/1980 | Ichiryu et al. | 137/625.63 |
| 4,319,609 | A | * | 3/1982 | Debrus | 137/625.63 |
| 4,337,796 | A | * | 7/1982 | Bonney | 137/625.17 |
| 5,213,133 | A | * | 5/1993 | Ellett | 137/596.14 |
| 5,437,304 | A | * | 8/1995 | Delcroix | 137/595 |
| 5,819,857 | A | * | 10/1998 | Rohrer | 173/90 |
| 6,543,481 | B2 | * | 4/2003 | Neff et al. | 137/625.63 |
| 6,772,791 | B2 | * | 8/2004 | Neff | 137/625.65 |
| 2007/0039653 | A1 | * | 2/2007 | Maggard | 137/625.19 |
| 2011/0155403 | A1 | * | 6/2011 | Rohrer | 173/114 |
| 2013/0112447 | A1 | * | 5/2013 | Rohrer, Jr. | 173/90 |

* cited by examiner

*Primary Examiner* — Robert Long

(74) *Attorney, Agent, or Firm* — Robert E. Howard

(57) ABSTRACT

An improved valve for a portable post driver. The post driver has an inner hollow cylinder open at both ends and adapted to receive a post through a lock clamp located at its lower end. An outer hollow cylinder having a closed upper end, and slightly larger in diameter than the inner cylinder, is located in sliding engagement over the inner cylinder. First and second power cylinders are attached to upper and lower surfaces of the outer cylinder in alignment with each other. A common piston rod connects the pistons of the power cylinders. A stationary fastening pin attached to the piston rod extends through a slot in the wall of the outer cylinder and is attached to the wall of the inner cylinder. The valve has a reciprocating valve piston which alternately communicates the two power cylinders to a source of fluid under pressure.

6 Claims, 5 Drawing Sheets

PORTABLE POST DRIVING APPARATUS

BACKGROUND OF THE INVENTION

This invention relates to a portable, power operated post driving apparatus that can be operated by a single person to drive a steel fence post, or other kinds of posts, into the ground in an expeditious manner.

Posts, particularly steel fence posts, have been driven into the ground in a number of different ways.

Originally, such posts were manually driven into the ground by using a sledge hammer. Other manually operated post drivers are described in U.S. Pat. Nos. 3,712,389 and 5,020,605.

Power driven post drivers of various sorts appear in the prior art. Examples include cam driven post drivers where an electric powered cam drives the hammer directly (U.S. Pat. No. 2,703,479) or where an electric or gas powered cam lifts the hammer and drops it (U.S. Pat. No. 4,984,640).

Various other power driven post drivers have been suggested by the prior art. These drivers use either compressed air or hydraulics to operate a fluid operated power cylinder arrangement wherein a weight assembly is lifted and lowered. One such device is described in U.S. Pat. No. 4,665,994 wherein the weight assembly comprises a metal disc and two solid metal bars. Such devices, although technically portable, are still very heavy because the combination of the weight of the weight assembly and the weight of the remainder of the apparatus. Such pneumatic post drivers use large amounts of compressed air, typically from 25 cubic feet per minute up to 125 cubic feet per minute. Such drivers require a relatively large air compressor to supply compressed air to the driver.

U.S. Pat. No. 5,819,857, issued to the inventor of the present apparatus, describes a vastly improved portable power driven post driver. The entire contents of U.S. Pat. No. 5,819,857 are hereby incorporated by reference.

The post driver of the '857 patent has an inner hollow cylinder open at both ends and adapted to receive a post through a lock clamp located at its lower end. An outer hollow cylinder having a closed upper end, and slightly larger in diameter than the inner cylinder, is located in sliding engagement over the inner cylinder. First and second power cylinders are attached to upper and lower surfaces of the outer cylinder in alignment with each other. A common piston rod connects the pistons of the power cylinders. A stationary fastening pin extends through a slot in the wall of the outer cylinder and is attached to the wall of the inner cylinder. A valve and conduit means communicate the two power cylinders to a source of fluid under pressure.

During operation of the post driver of the '857 patent, a post is inserted through the lock clamp in the lower end of the inner cylinder until it abuts the closed upper end of the outer cylinder and is locked in place. The valve alternately communicates the fluid under pressure with the first and second power cylinders to alternately raise the outer cylinder above the inner cylinder and then to drive the outer cylinder downward until the closed end thereof forcefully contacts the upper end of the post. The outer cylinder has handle means attached thereto to permit an operator to carry and hold the driver during operation. The post driver is thus configured to cause all of the weight of the driver, except for the weight of the inner cylinder, to drivingly engage a post to be driven.

The valve employed in the post driver of the '857 patent is a four way spool valve, such as Model No. 422CS011K manufactured by Parker. It has been found that although this valve functions to properly operate the post driver, it is expensive and difficult to perform maintenance thereon.

SUMMARY OF THE INVENTION

It is an object of the present invention to provide a valve for the post driver described in the '857 patent which is simple, inexpensive, and easy to perform maintenance thereon.

The valve of the present invention has a front wall, rear wall, top wall, bottom wall and right and left side walls.

A central bore passes through the valve from the top wall to the bottom wall.

A cylindrical valve piston is located within the central bore. The valve piston has at least two spaced apart O-rings circumferentially attached thereto and adapted to come into sliding and sealing contact with the wall of the central bore.

A primary fluid supply passageway extends from the left side wall into the central bore and is adapted to communicate the central bore with a supply of pressurized fluid.

A first secondary fluid passageway extends from the central bore to the exterior of the valve body and is adapted to communicate with the first fluid powered cylinder of the post driver.

A second secondary fluid passageway extends from the central bore to the exterior of the valve body and is adapted to communicate with the second fluid powered cylinder of the post driver.

The valve piston is adapted to reciprocate between a first position wherein the space between the spaced apart O-rings communicates the primary fluid supply passageway with the first secondary fluid passageway to a second position wherein the space between the spaced apart O-rings communicates the primary fluid passageway with the second secondary fluid passageway.

DESCRIPTION OF PREFERRED EMBODIMENTS

Figure 1A:
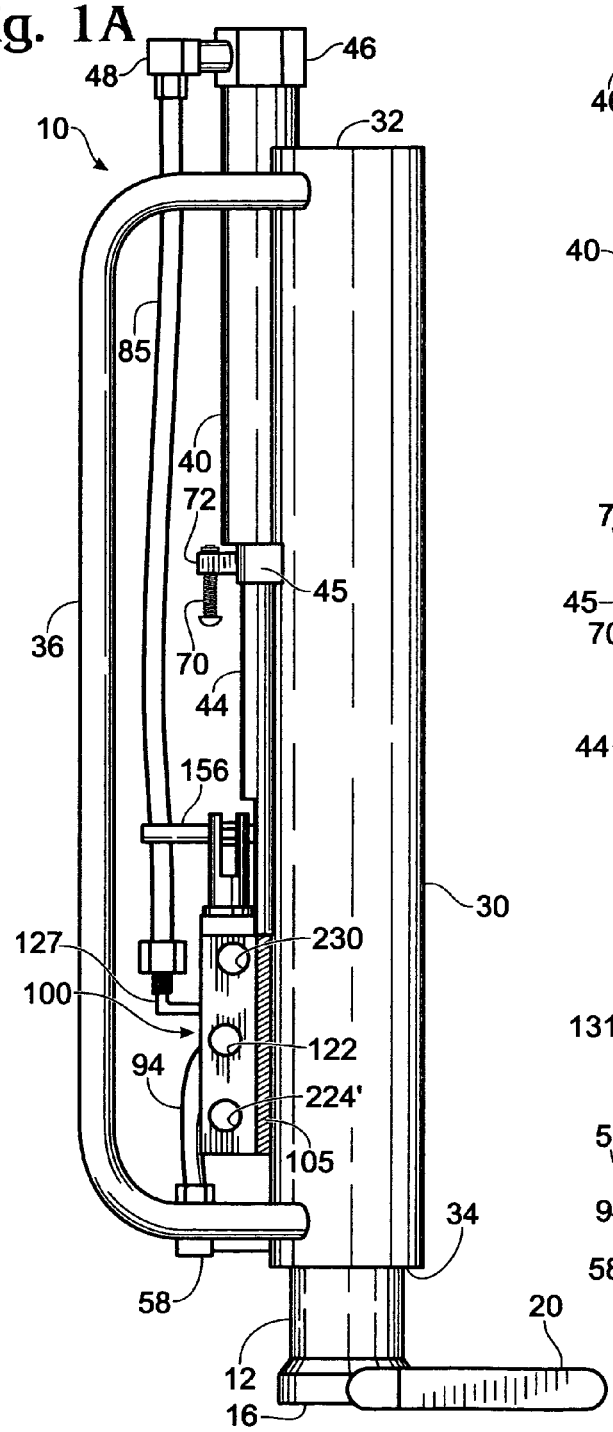
FIGS. 1A and 1B are elevation views of the post driver of the present invention.
Figure 1B:
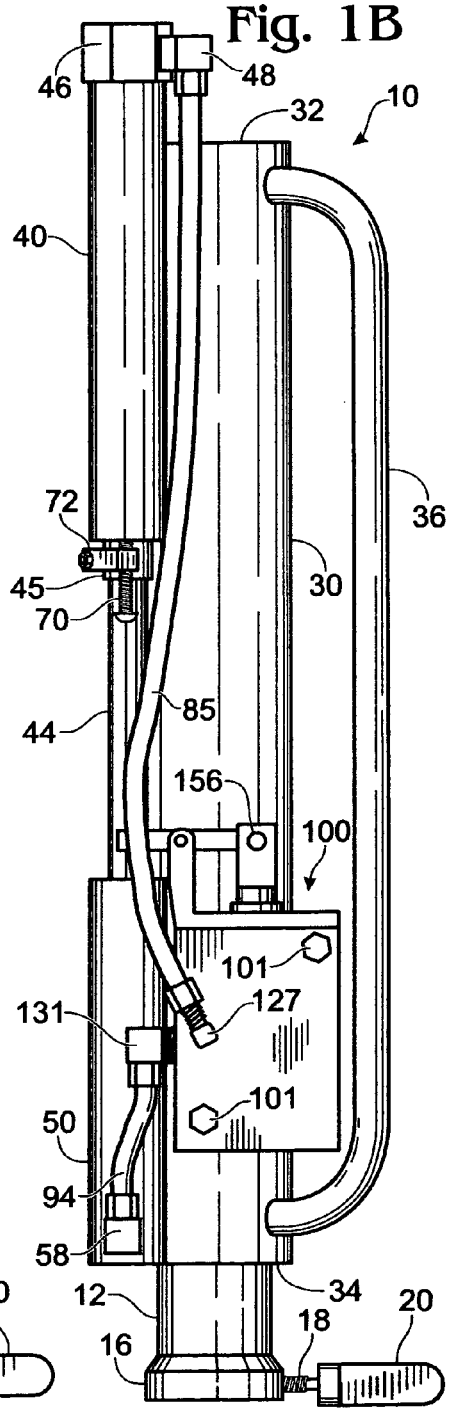

As seen in FIGS. 1A and 1B, post driver 10 has an inner hollow cylinder 12 open at its upper (inner) end. Attached to the lower (outer) end of inner cylinder 12 is a clamp sleeve 16 having threaded clamp pin 18 extending there through, clamp pin 18 having a clamp handle 20 attached to its outer end.

Post driver 10 has an outer hollow cylinder 30 closed at its upper end 32 and open at lower end 34. The inner diameter of outer cylinder 30 is slightly larger than the outer diameter of inner cylinder 12 to permit inner cylinder to be nested inside outer cylinder 30 in sliding engagement. An operator's handle 36 is attached to the exterior of outer cylinder 30.

Figure 2:
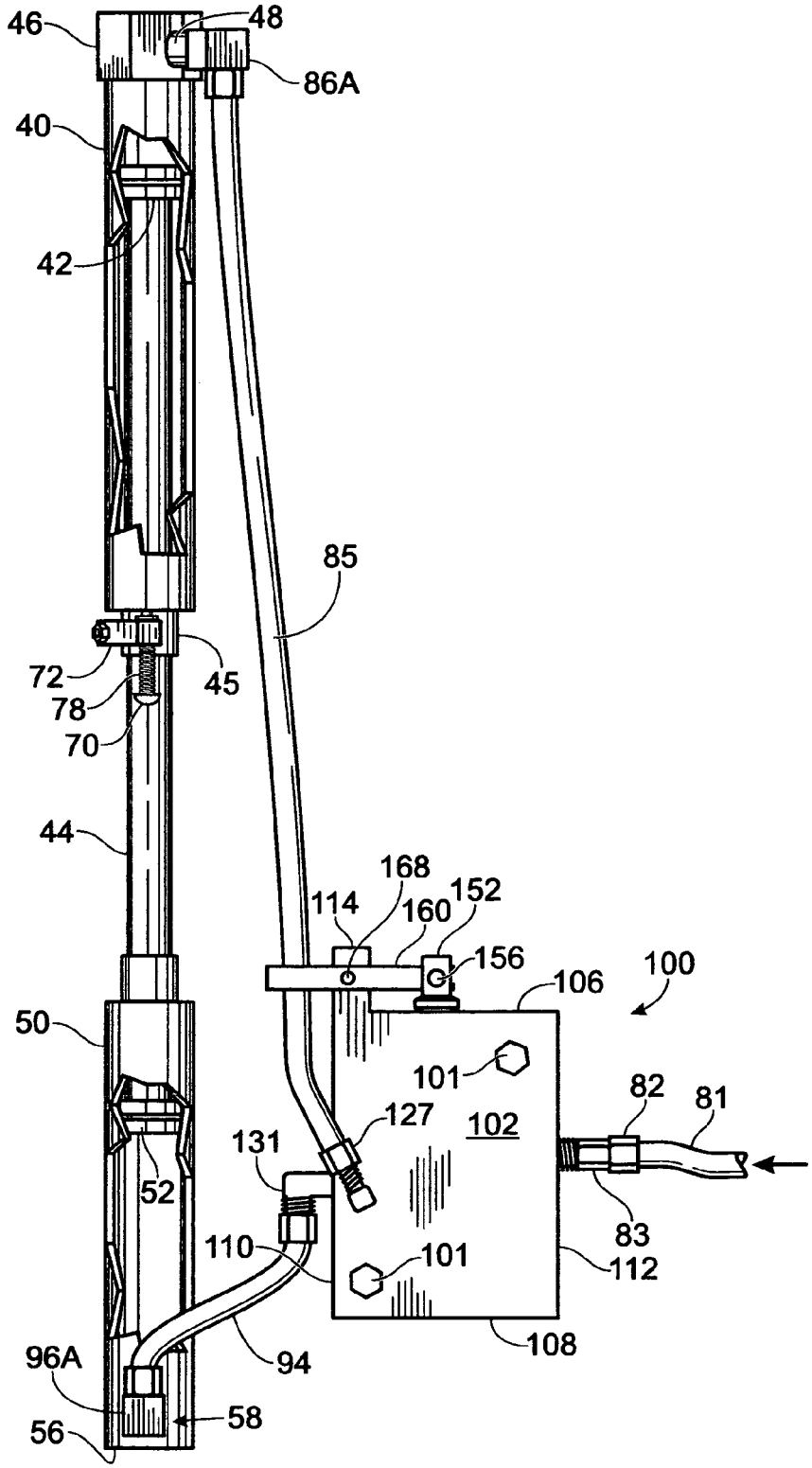
FIG. 2 is an elevation view, partially in section, of the power cylinders and valve.

A first (upper) fluid powered cylinder 40 is fixedly attached to an upper outer surface of outer cylinder 30, such as by welding. Inside upper power cylinder 40, as seen in FIG. 2, is a piston 42 attached to the upper end of piston rod 44. Piston rod 44 has a thick shoulder portion 45 at its mid-portion. The upper end of power cylinder 40 is threaded and has a screw cap 46 securely attached thereto. Threaded hollow fitting 48 communicates the inside of upper power cylinder 40 with the outside thereof and is located in screw cap 46. Threaded hollow fitting 48 is connected to the upper end of first rigid air conduit 85.

A second (lower) fluid powered cylinder 50 is fixedly attached to a lower outer surface of outer cylinder 30, such as by welding. Inside lower power cylinder 50, as best seen in FIG. 2, is a piston 52. The longitudinal axes of upper power cylinder 40 and lower power cylinder 50 are in alignment with each other, and piston rod 44 is attached at its lower end to piston 52. The bottom 56 of lower power cylinder 50 is closed. Threaded hollow fitting 58 communicates the inside of lower power cylinder 50 with the outside thereof in a location between bottom 56 and piston 52 at the closest approach of piston 52 to bottom 56. Threaded hollow fitting 58 is attached to the lower end of second rigid air conduit 94.

Piston rod 44 is attached to inner cylinder 12 by attachment means extending through a vertical slot in the wall of outer cylinder 30 in the manner described in U.S. Pat. No. 5,819,857.

A deactivation pin 70 extends through an arm 72 which is attached to piston rod 44 as described in greater detail in U.S. Pat. No. 5,819,857. A spring 78 surrounding the stem portion of deactivation pin 70 keeps it in a normally fully extended position, but permits it to retract upon application of a force to the enlarged head portion thereof.

Figure 3:
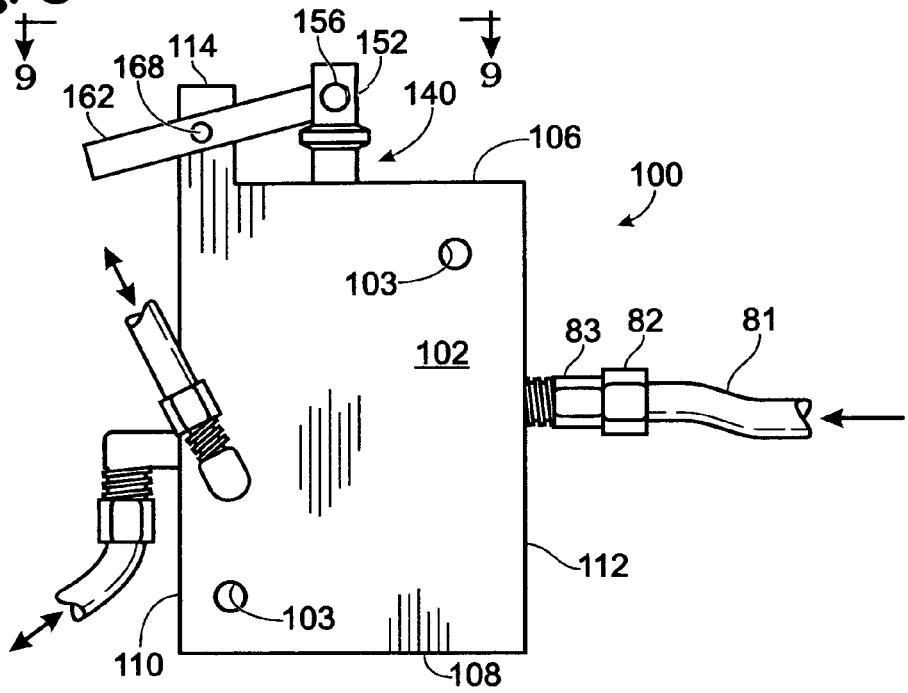
FIG. 3 is a front elevation view of the valve of the present invention.
Figure 9:
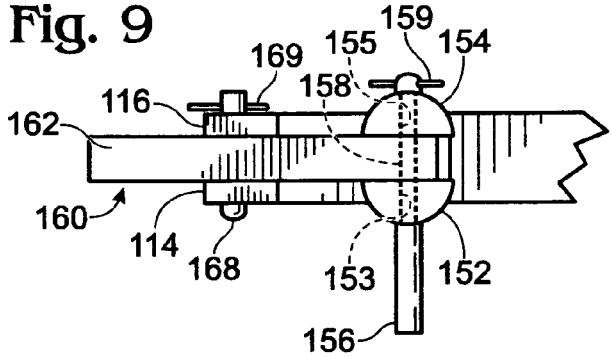
FIG. 9 is a top plan view of the control lever of the valve of the present invention.
Figure 4:
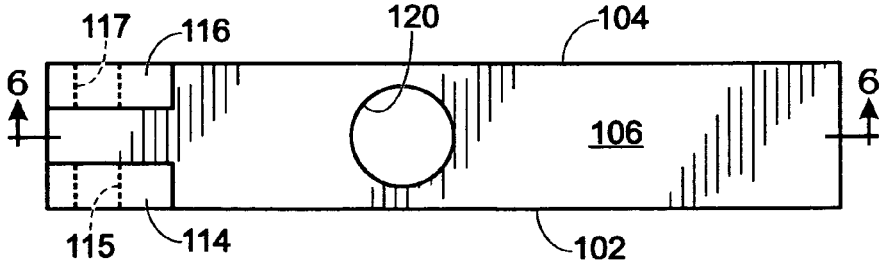
FIG. 4 is a top plan view of the valve of the present invention.

As best seen in FIGS. 3 and 4, valve 100 is attached to a plate 105 attached to the lower outer surface of outer cylinder 30 by any suitable means, such as bolts 101 passing through openings 103 and nuts (not shown).

Figure 5:
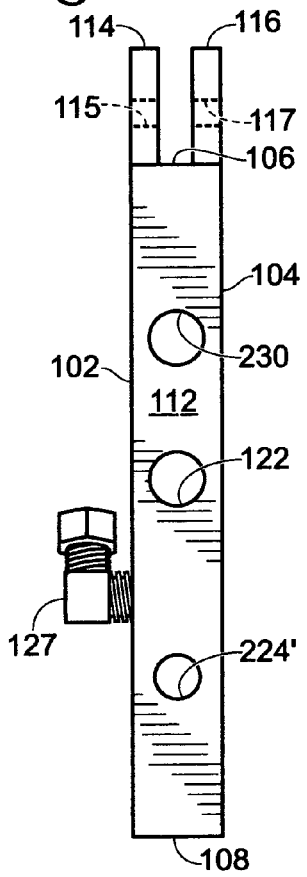
FIG. 5 is a side elevation view of the valve of the present invention.

As best seen in FIGS. 3-5, valve 100 has a generally rectangular-shaped body with front wall 102, rear wall 104, upper wall 106, lower wall 108, and side walls 110 and 112. Ears 114 and 116 extend upwardly from the upper wall 106 thereof adjacent side wall 110. Ears 114 and 116 have central openings 115 and 117, respectively, passing there through. Openings 115 and 117 have a common central axis.

Figure 6:
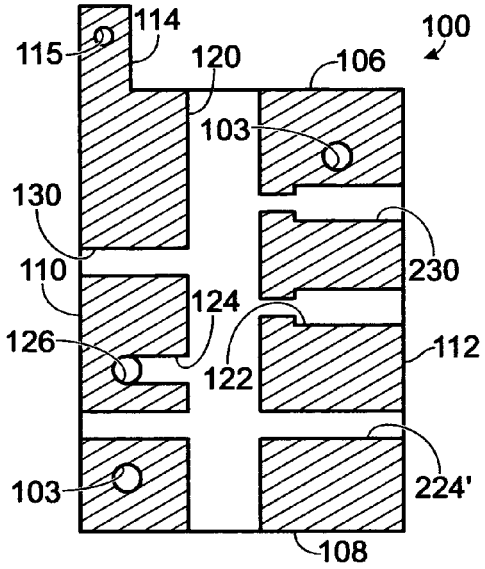
FIG. 6 is a front elevation in cross-section of the valve of the present invention.

As best seen in FIG. 6, a central bore 120 extends through a mid-portion of valve 100 between the upper wall 106 and lower wall 108.

A primary pressurized fluid (e.g., pressurized air) supply passageway 122 communicates central bore 120 with the exterior of valve 100 through side wall 112. That portion of primary pressurized fluid supply passageway 122 adjacent side wall 112 is enlarged and internally threaded in order to receive a threaded quick release fitting 83 (FIG. 2).

A first (lower) fluid exit passageway is comprised of fluid exit passageway portion 124 and fluid exit passageway portion 126. Fluid exit passageway portion 124 of first fluid exit passageway communicates with central bore 120 at its inner end and extends into communication with internally threaded lower fluid exit passageway portion 126 at its outer end. Fluid exit passageway portion 126 of first fluid exit passageway is substantially perpendicular to fluid exit passageway portion 124 and extends through front wall 102, thereby communicating central bore 120 with the exterior of valve 100. That part of fluid exit passageway portion 126 adjacent front wall 102 is internally threaded and adapted to receive a threaded hollow fitting 127 (FIGS. 1B, 2 and 5) which is connected to the lower end of rigid air tubing 85.

A second (upper) fluid exit passageway 130 extends from central bore 120 through side wall 110 and communicates central bore 120 with the exterior of valve 100. That portion of upper fluid exit passageway 130 adjacent side wall 110 is internally threaded and adapted to receive a threaded hollow fitting 131 (FIGS. 1B and 2) which is connected to the upper end of rigid air tubing 94.

First exhaust conduits 224, 224' and second exhaust conduit 230 allow fluid to be exhausted from first and second fluid powered cylinders 40 and 50 in a manner to be described below.

Figure 7:
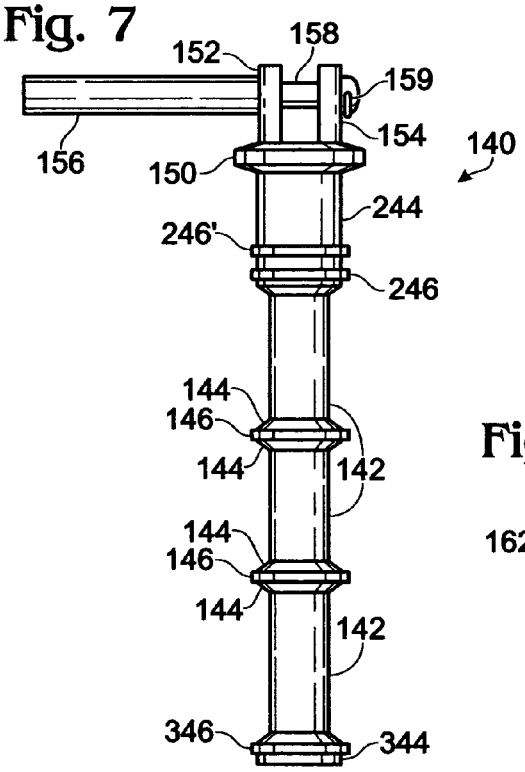
FIG. 7 is a side elevation view of the valve piston of the valve of the present invention.
Figure 11:
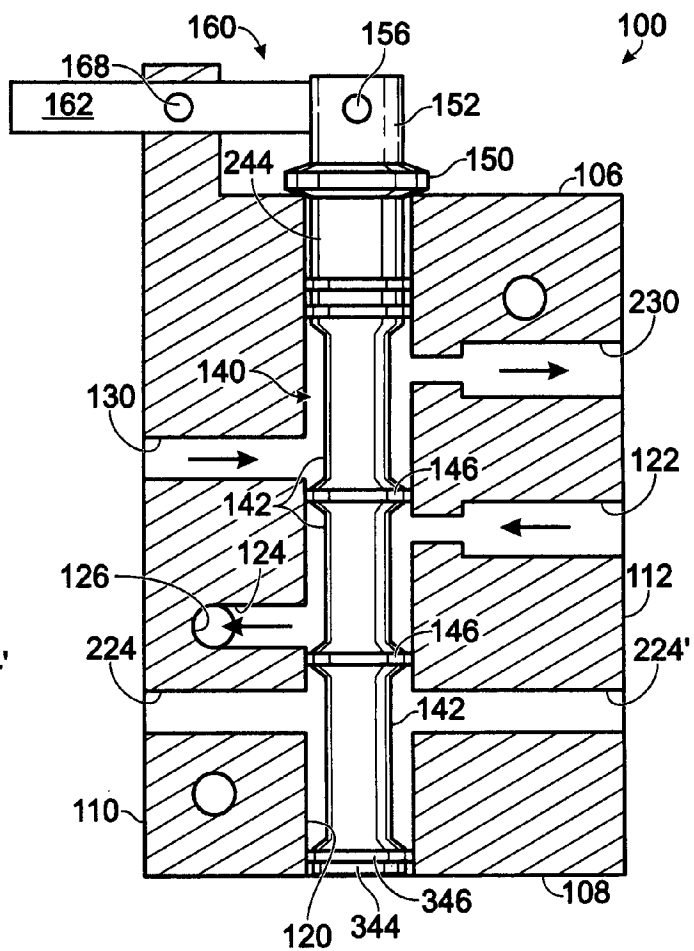
FIG. 11 is a side elevation view of the valve and valve piston shown in its down position
Figure 10:
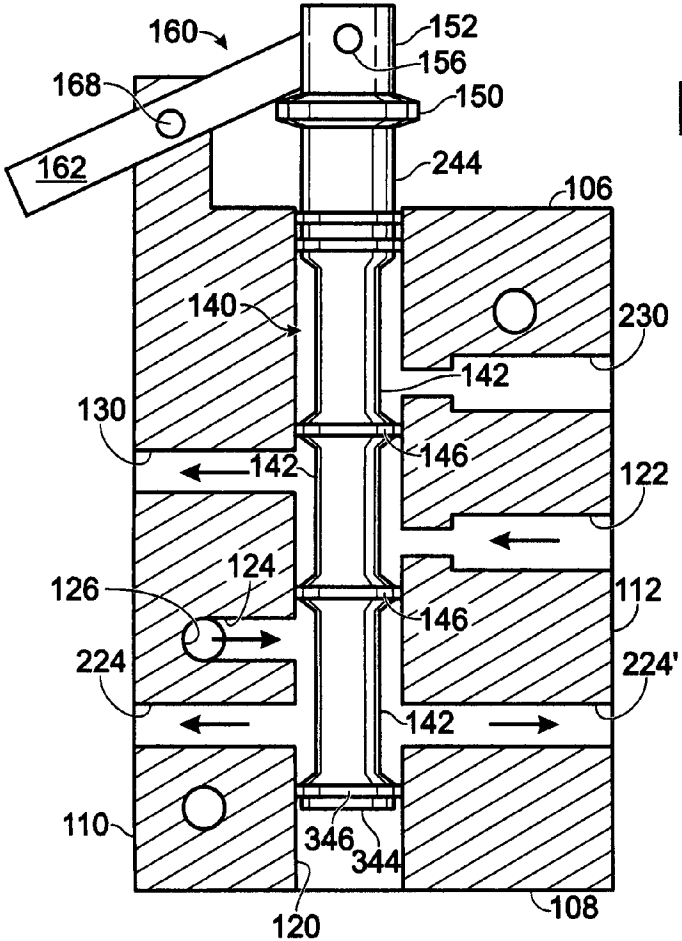
FIG. 10 is a side elevation view of the valve and valve piston shown in its up (off) position.

A hollow cylindrical valve piston 140 (FIG. 7) is adapted to be received within central bore 120 of valve 100 (FIGS. 10 and 11). Valve piston 140 has a central cylindrical portion 142 having a diameter slightly smaller than the diameter of central bore 120. O-ring receiving flanges 144 extend outwardly from cylindrical portion 142 and retain O-rings 146. Upper portion 244 of valve piston 140 contains adjacent circumferential grooves which retain O-rings 246, 246'. The lower end 344 of valve piston 140 retains O-ring 346.

The upper end of valve piston 140 terminates in shoulder 150. Piston ears 152 and 154 are attached to or integral with shoulder 150 and extend upwardly therefrom. Piston ears 152 and 154 having circular openings 153 and 155 extending there through, openings 153 and 155 having a common central axis. A cylindrical handle 156, made of plastic, has a cylindrical stem portion 158 made of steel press fit therein which extends outwardly therefrom. Stem 158 extends through openings 153 and 155 in piston ears 152 and 154 and is removably attached thereto by cotter pin 159.

Figure 8:
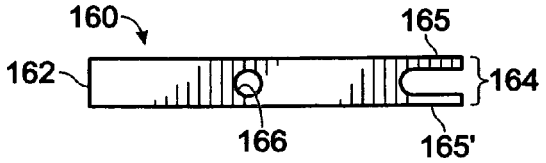
FIG. 8 is a side elevation view of the control lever of the valve of the present invention.

A pivoting control lever 160 (FIG. 8), having a substantially rectangular cross-section, has an inner end 162 and a forked outer end 164. The space between the tines 165, 165' of forked outer end 164 receive stem 158 of handle 156 there through. An opening 166 passes through control lever 160 slightly forward of the middle thereof. Control lever 160 is pivotally attached to valve ears 114 and 116 by means of a pivot pin 168 having an enlarged head passing through opening 166 in control lever 160 and openings 115 and 117 in valve ears 114 and 116. The outer end of pivot pin 168 is held in place by a cotter pin 169 or other suitable means.

Valve piston 140 is movable within central bore 120 between an "up" position shown in FIG. 10 to a "down" position shown in FIG. 11.

In operation valve 100 is connected to a source of pressurized fluid, such as a compressed air source, via flexible hose 81 having a quick release fitting connection 82 at its outer end. Quick release fitting 82 is connected to a corresponding quick release fitting 83 located in threaded opening 122 of valve 100. Control lever160 is in the up (off) position shown in FIG. 10. A post (not shown), such as a conventional steel fence post having a T-shaped cross section, is inserted into inner cylinder through a T-shaped opening in clamp sleeve 16 while the driver 10 is in a substantially horizontal position, i.e., laying on the ground. The lower (outer) end of the post is placed at the location on the ground where the post is to be driven, driver 10 raised to a substantially vertical position, and the post caused to slide into inner cylinder 12 and through the open upper end thereof until the upper end firmly contacts closed end 32 of outer cylinder 30. The post is then locked into place by turning clamp handle 20 attached to threaded clamp pin 18 clockwise until the inner end of clamp pin firmly contacts the post.

During start-up, control lever 160 of valve 100 is in its up (off) mode shown in FIG. 10, thereby causing compressed air to flow from valve 100 via upper fluid bore 130 to lower power cylinder 50 through rigid air tubing 94, which keeps outer cylinder 30 in its retracted position.

To actuate driver 10 the operator pushes down on handle 156 of control lever 160 to place valve 100 into its on (operating) mode, as shown in FIG. 11. In its initial operating mode, the position of piston 140 causes air to flow via conduits 124 and 126 into upper power cylinder 40 via rigid hose 85. Compressed air flowing into upper power cylinder 40 pushes downwardly on piston 42. Since piston rod 44 is fixedly attached to inner cylinder 12, downward pressure on piston 42 raises outer cylinder 30 together with everything attached to it, which is everything constituting driver 10 except inner cylinder 12.

As outer cylinder 30 approaches its outermost vertical extension, the outer end 162 of control lever 160 contacts and is pushed down by spring loaded deactivation pin 70. This raises the inner end 164 of control lever 160, thereby raising valve piston 140 to the position shown in FIG. 10 which shuts off communication of the compressed air to upper power cylinder 40 and opens communication between upper power cylinder 40 and the atmosphere via first exhaust conduits 224, 224'. At the same time, valve 100 opens communication between the compressed air source and lower power cylinder 50 via conduit 130. Compressed air entering lower power cylinder 50 via rigid hose 94 pushes against piston 52. This action drives outer cylinder 30 downwardly and into driving communication with the upper end of the post. Having two exhaust conduits 224, 224' insures that any air within upper power cylinder 40 is allowed to exhaust freely and not impede the downward movement of outer cylinder 30 into driving contact with the post being driven.

As closed end 32 of outer cylinder 30 strikes the upper end of the post, the inertial forces generated causes the inner end 164 of control lever 160 to pivot downwardly, thereby pushing valve piston 140 downwardly to the position shown in FIG. 11 which shuts off communication of the compressed air to lower power cylinder 50 and opens communication between lower power cylinder 50 and the atmosphere via third fluid exit passageway 130 and second exhaust conduit 230. At the same time, communication between valve 100 and upper power cylinder 40 via conduits 124 and 126 is reopened, thereby once again raising the outer cylinder 30. The inner end of third fluid exhaust conduit 230, located adjacent central bore 120, has a smaller diameter than the outer end thereof, the diameter of the inner end being of a size adapted to control the rate of exhaustion of air from lower fluid powered cylinder 50 to thereby dampen the velocity of outer cylinder 30 during its upward stroke to prevent "hammering" and a tendency to pull the post out of the ground.

The raising and driving cycle is automatically repeated until the post is driven to its desired depth. At that point the operator waits for a downward (driving) stroke of outer cylinder 30 and then raises handle 156 of control lever 160 upwardly to its off position. This causes compressed air to be fed to lower power cylinder 50 thus retaining outer cylinder 30 in its retracted position.

During driving of the post into the ground, outer cylinder 30 and everything attached to it, including the handle 36 held by the operator, reciprocates up and down, driving the post into the ground at the end of each downward or driving stroke of outer cylinder 30. The stroke of piston 42 is not very great, about 7.5 inches, so that the reciprocating motion of the handle 36 is not bothersome to the operator.

Power cylinders 40 and 50 are relatively small, having a bore of about 1.0 inch in diameter. As a result, a lower air pressure of less than about 100 psi, preferably between about 70 psi and about 90 psi can be used. At a pressure of 85 psi driver 10 uses about 2 cfm of air.

In commercial embodiments of this invention, driver 10 would have a safety shield (not illustrated) placed over exposed piston rod 44.

It will be obvious to those having skill in the art that many changes may be made to the details of the above-described embodiments of this invention without departing from the underlying principles thereof. The scope of the present invention should, therefore, be determined only by the following claims.

The invention claimed is:

1. In a portable post driver having an outer hollow cylinder having a closed upper end and an inner hollow cylinder located within said outer cylinder, said inner cylinder being open at its upper end and adapted to receive and hold a post; a first pneumatic powered cylinder and first piston attached to an upper outer surface of said outer cylinder; a second pneumatic powered cylinder and a second piston attached to a lower outer surface of said outer cylinder; said first and second pneumatic powered cylinders having a common longitudinal axis; a piston rod connecting said first and second pistons, said piston rod being attached to said inner cylinder by fastening means extending through a slot in a wall of said outer cylinder; and a valve for receiving compressed air and cyclically directing said compressed air to said first pneumatic powered cylinder through a first conduit to raise said outer cylinder above said inner cylinder from a first lowered position to a second raised position and then directing air to said second pneumatic powered cylinder through a second conduit to thereby drive said outer cylinder down to said first position from said second position; the improvement comprising:

said valve having a front wall, rear wall, top wall, bottom wall and right and left side walls;

said valve having a central bore passing through said valve from said top wall to said bottom wall;

a cylindrical valve piston located within said central bore, said piston having two spaced apart O-rings attached thereto and adapted to come into sealing contact with the wall of said central bore;

a primary pressurized air supply passageway extending from said left side wall into said central bore and adapted to communicate a supply of pressurized air with said central bore;

a first pressurized air exit passageway extending from said central bore and into communication with said first conduit;

a second pressurized air exit passageway extending from said central bore and into communication with said second conduit;

a first exhaust means communicating said first pneumatic powered cylinder with the atmosphere via said valve when said first pneumatic powered cylinder is not in communication with said primary pressurized air supply passageway, said first exhaust means including first and second exhaust conduits, the inner ends of each of said first and second exhaust conduits being in communication with said central bore and the outer ends of each of said two first exhaust conduits being in communication with the atmosphere, said first and second exhaust conduits being of a size adapted to allow fluid to freely exit from said first pneumatic powered cylinder to the atmosphere and not impede its movement as it is driven down to said first position;

a second exhaust means consisting of a third exhaust conduit communicating said second pneumatic powered cylinder with the atmosphere via said valve when said second pneumatic powered cylinder is not in communication with said primary pressurized air supply passageway; and means for reciprocating said valve piston from a first position to a second position, wherein at said first position said space between said spaced apart O-rings is adapted to communicate said primary pressurized air supply passageway with said first pressurized air exit passageway, and communicate said second pressurized air exit passageway with said third exhaust conduit of said second exhaust means, and wherein at said second position said space between said spaced apart O-rings is adapted to communicate said primary pressurized air passageway with said second pressurized air exit passageway, and communicate said first pressurized air exit passageway with both of said first and second exhaust conduits of said first exhaust means simultaneously.

2. The portable post driver of claim 1 including a control lever having an inner end and an outer end, said control lever being pivotally attached at a mid-portion thereof to said valve, said inner end being pivotally attached to said valve piston adjacent its upper end, said outer end being in a raised position when said valve piston is in said first piston position and in a lowered position when said valve piston is in said second piston position.

3. The portable post driver of claim 2 wherein said means for reciprocating said valve piston from said first piston position to said second piston position includes means for contacting and pushing down on said outer end of said pivoting control lever as said outer cylinder approaches said second raised position.

4. The portable post driver of claim 2 wherein said movement of said outer cylinder from said second raised position to said first lowered position generates sufficient inertial force to cause said valve piston to move from said second piston position to said first piston position.

5. The portable post driver of claim 1 wherein said third exhaust conduit of said second exhaust means has an inner end that is in communication with said central bore and whose outer end is in communication with the atmosphere, said third exhaust conduit being configured to control the rate of exhaustion of fluid from said third fluid powered cylinder to thereby dampen the velocity of outer hollow cylinder as it is being raised from said first position to said second position.

6. The portable post driver of claim 5 wherein said inner end of said third exhaust conduit has a diameter smaller than the diameter of said outer end, said diameter of said inner end adapted to control said rate of exhaustion of fluid from said second fluid powered cylinder during the upward movement of said outer hollow cylinder to prevent hammering.

* * * * *